US011260277B2

(12) United States Patent
Solano

(10) Patent No.: US 11,260,277 B2
(45) Date of Patent: Mar. 1, 2022

(54) GOLF TEE DISPENSER

(71) Applicant: Joel M. Solano, La Quinta, CA (US)

(72) Inventor: Joel M. Solano, La Quinta, CA (US)

( * ) Notice: Subject to any disclaimer, the term of this patent is extended or adjusted under 35 U.S.C. 154(b) by 0 days.

(21) Appl. No.: 16/701,112

(22) Filed: Dec. 2, 2019

(65) Prior Publication Data

US 2021/0162282 A1 Jun. 3, 2021

(51) Int. Cl.

| | |
|---|---|
| ***A63B 57/20*** | (2015.01) |
| ***B65D 83/02*** | (2006.01) |
| *A63B 55/00* | (2015.01) |

(52) U.S. Cl.

CPC ..... *A63B 57/203* (2015.10); *B65D 83/02* (2013.01); *A63B 55/408* (2015.10)

(58) Field of Classification Search

CPC ..... A63B 57/203; A63B 55/408; B65D 83/02
USPC ..... 221/220; 473/386
See application file for complete search history.

(56) References Cited

U.S. PATENT DOCUMENTS

| | | | | |
|---|---|---|---|---|
| 3,874,570 A * | 4/1975 | Katzman | B65D 35/42 | 222/543 |
| 3,891,130 A * | 6/1975 | Brennan | A63B 57/203 | 224/249 |
| 4,141,558 A * | 2/1979 | Hoffman | A63B 57/0006 | 124/50 |
| 4,892,318 A * | 1/1990 | Jennings | A63B 47/002 | 473/137 |
| D389,547 S * | 1/1998 | Smallwood | D3/221 | |
| 8,162,173 B2 * | 4/2012 | Pommereau | A63B 47/002 | 221/174 |
| 9,737,774 B1 * | 8/2017 | Riley | B65D 83/02 | |
| 2003/0127469 A1 * | 7/2003 | Terry | B65D 25/56 | 222/158 |
| 2012/0097556 A1 * | 4/2012 | Gascoine | B65D 1/06 | 206/216 |

* cited by examiner

*Primary Examiner* — Nini F Legesse
(74) *Attorney, Agent, or Firm* — Savantek Patent Services; Ivan E. Rozek

(57) ABSTRACT

A golf tee dispenser with a funnel shaped container, a first retaining cap, a second retaining cap, the funnel shaped container capable of holding a plurality of standard golf tees the funnel shaped container has a threaded cylindrical aperture. The first retaining cap is removably retained to the funnel shaped dispenser by mating threads. The first retaining cap is retained to the funnel shaped container by a tether. The first retaining cap includes a plurality of resilient fingers to facilitate the controlled release of one golf tee at a time from the funnel shaped container. The second retaining cap is frictionally retained to the outer surface of the first retaining cap. A preferred embodiment includes a U-shaped handle member fixedly attached to the top surface of the funnel shaped container.

4 Claims, 10 Drawing Sheets

GOLF TEE DISPENSER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable container and dispenser and more specifically to golf tee dispenser.

Golf tees are small dowels that taper on one end and have a concave-shaped head on the other. The tapered end is used to pierce the ground to maintain the tee vertically so as to allow a golf ball to be supported on the concave-shaped end. They are regularly used by golfers to suspend a golf ball at a desired distance above the ground prior to hitting the ball with a golf club.

A logical extension of using golf tees is to have some sort of golf tee container that can conveniently hold a plurality of tees. A further refinement of a standard container would be to have the ability of the container to release one golf tee at a time.

Ronnie Covington et al in his U.S. Pat. No. 5,775,538 shows a golf tee container that allows golf tees to be pulled out in a controlled manner from the bottom of the container through a plurality of holes. This patent is now in the public domain. John Balazs in his patent application Ser. No. 12/351,744 proposed a net-like bag that allowed golf tees to protrude from the netting and be removed one at a time by a user. This patent was never issued; therefore, the technology is now in the public domain. Although the aforementioned designs help organize and release golf tees, they do not provide the most efficient way for the stored golf tees to exit the bottom of the container without undue shaking or other manipulation. Neither the Balazs patent application or the Covington patent provide a method to dispense one tee at a time in an organized way. Gregory Stanley's U.S. Pat. No. 9,737,774 shows a golf tee container that attempts to deliver one tee at a time, however, because the container shape has parallel side walls, it does nothing to attempt to direct the tees to the dispensing cap. Stanley's patent proposes a "deflector" to deflect tees away from the tee-opening, however does not include a funnel type shape to actually encourage the tees to move toward the tee-opening. The Stanley patent proposes "agitation" to help get the tees out of the opening. None of the prior art golf tee dispensers propose having the container be funnel shaped to facilitate the automatic dispensing of single golf tees without needing excessive agitation.

BRIEF SUMMARY OF THE INVENTION

The primary object of the invention is to provide a container for golf tees that can dispense the tees one at a time.

Another object of the invention is to provide a container for golf tees that is funnel shaped to facilitate the smooth dispensing of golf tees without needing extensive agitation to cause the tee to be exposed at the exit aperture of the dispensing container.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a golf tee dispenser comprising: a funnel shaped container, a first retaining cap, a second retaining cap, said funnel shaped container capable of holding a plurality of standard golf tees, said funnel shaped container having a threaded cylindrical aperture, said first retaining cap removably retained to said funnel shaped dispenser by mating threads, said first retaining cap retained to said funnel shaped container by a tether attached at one end to the side of said first retaining cap and at the opposite end to the side wall of said funnel shaped container, said first retaining cap includes a plurality of resilient fingers to facilitate the controlled release of one golf tee at a time from said funnel shaped container, and said second retaining cap frictionally retained to the outer surface of said first retaining cap.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
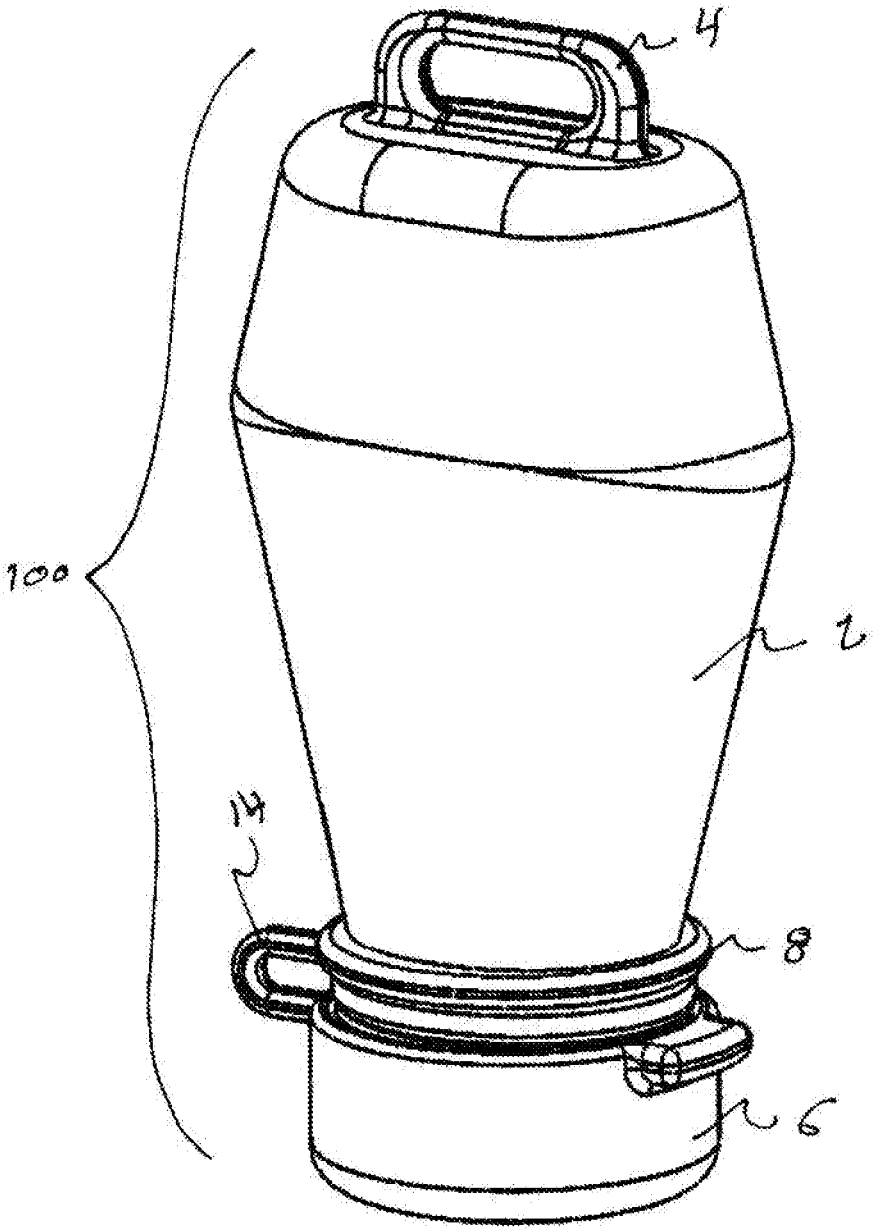
FIG. 1 is a perspective view of the invention.

Referring now to FIG. 1 we see a perspective view of the invention 100. The container 2 has slanted sides that create a funnel shape. The angle of the slant is approximately fifteen degrees. A second cap 6 is attached to the container 2 via a tether 14. The tether 14 is held onto the container via a ring 8. An inverted U-shaped handle 4 allows the user to attach the container 2 via a carabiner or other standard attachment means.

Figure 2:
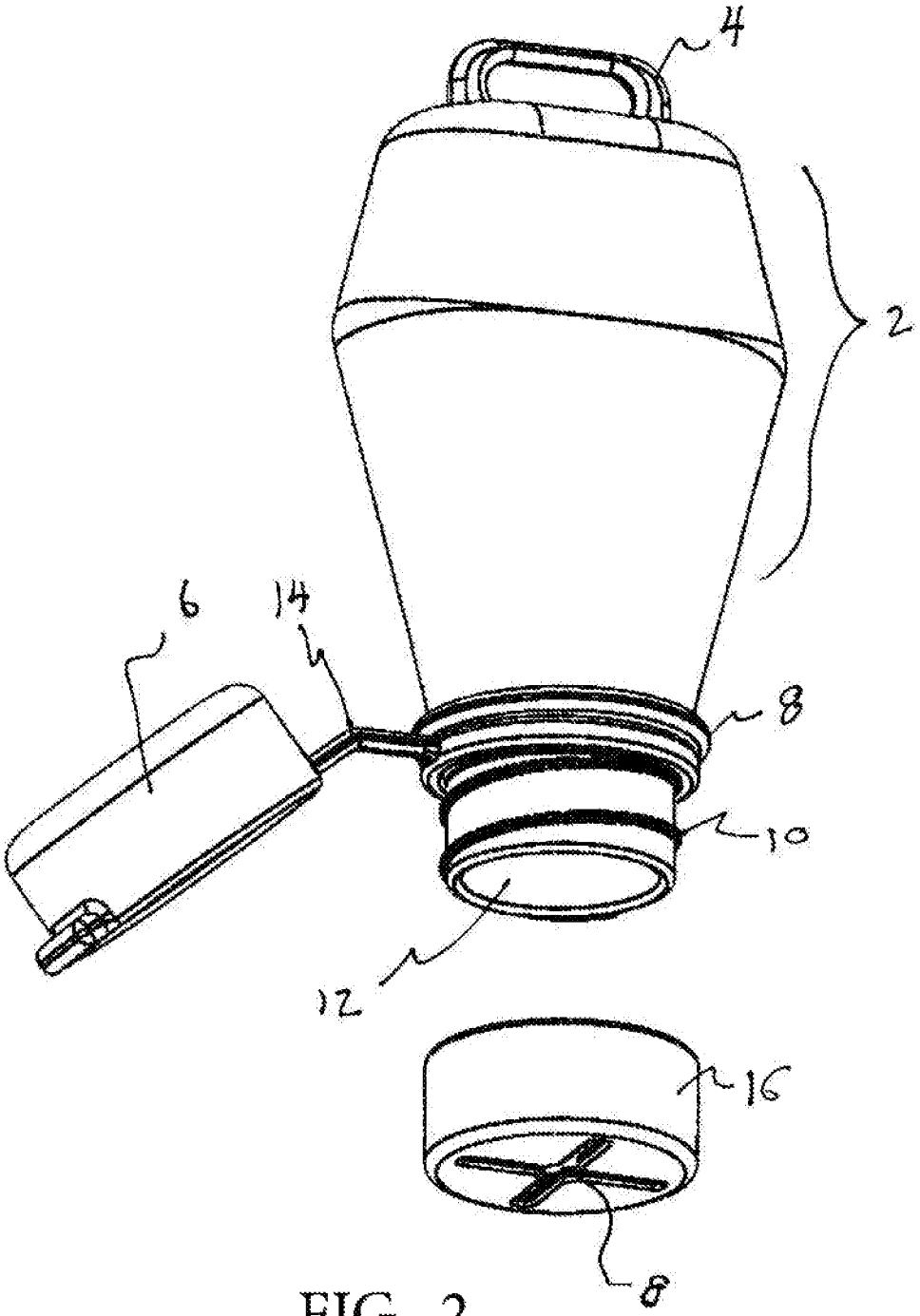
FIG. 2 is a perspective view of the invention with the first and second caps removed

FIG. 2 is a perspective view of the invention 100 showing the second cap 6 removed and the first cap 16 also removed. The first cap includes internal threads that mate with external threads 10 located at the exit aperture 12 of the container 2. The first cap includes a plurality of flexible fingers 8 that can deflect to allow a standard golf tee to exit.

Figure 3:
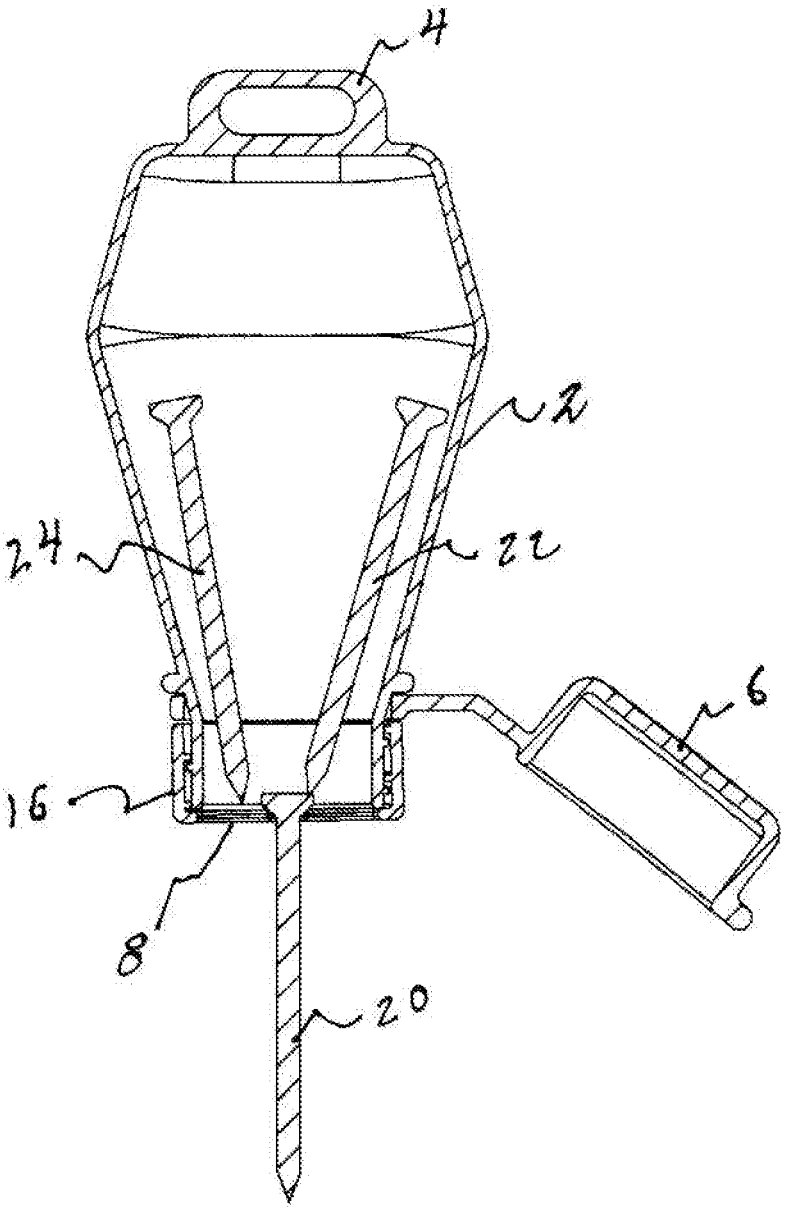
FIG. 3 is a side section view of the invention.

FIG. 3 is a side section view of the invention 100. Golf tees 22, 24 can be seen leaning against the funnel shaped walls of container 2. This configuration urges the golf tees 22, 24 to the center of cap 16. This configuration makes the tees want to exit the center of finger members 8 without undue shaking or agitation. As shown by the tee 20.

Figure 4:
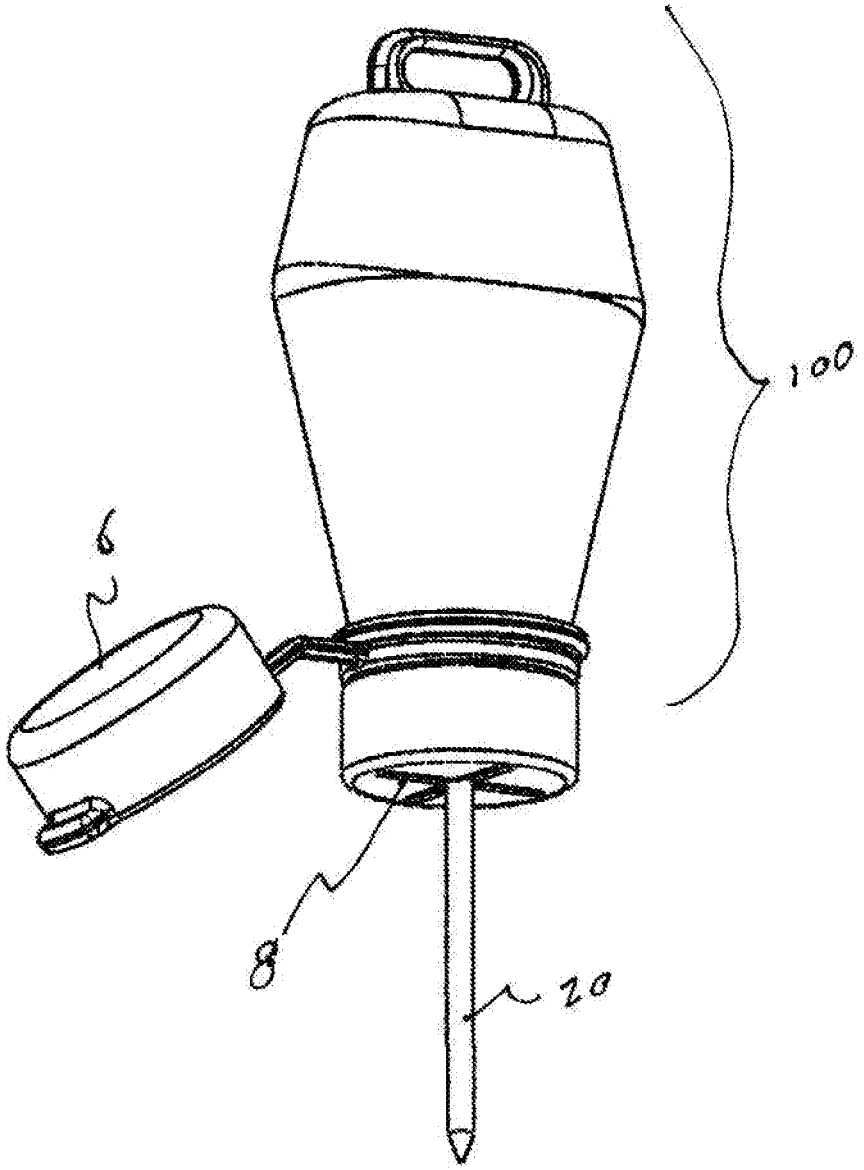
FIG. 4 is a perspective view of the invention showing one tee being ready to be dispensed.
Figure 5:
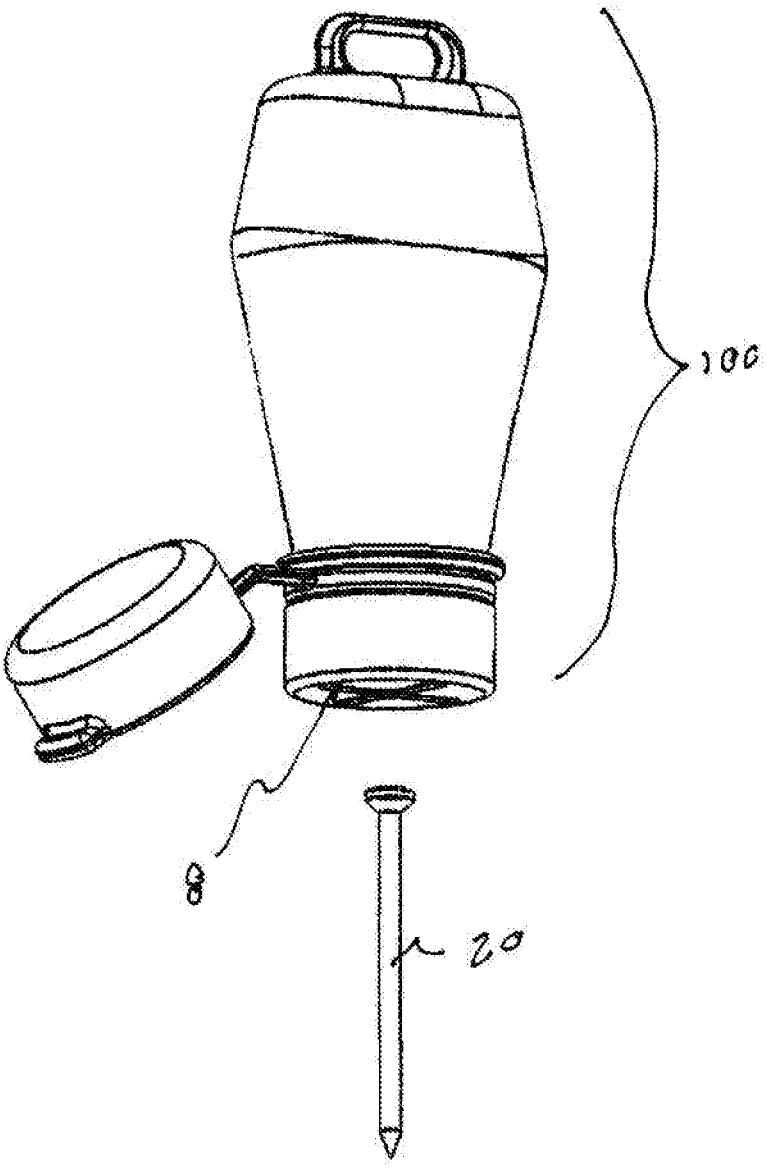
FIG. 5 is a perspective view of the invention with one tee released.

FIG. 4 is a perspective view of the invention with one tee ready to be pulled out. The tee can remain in this condition until the user wants to completely pull it out as shown in FIG. 5.

Figure 6:
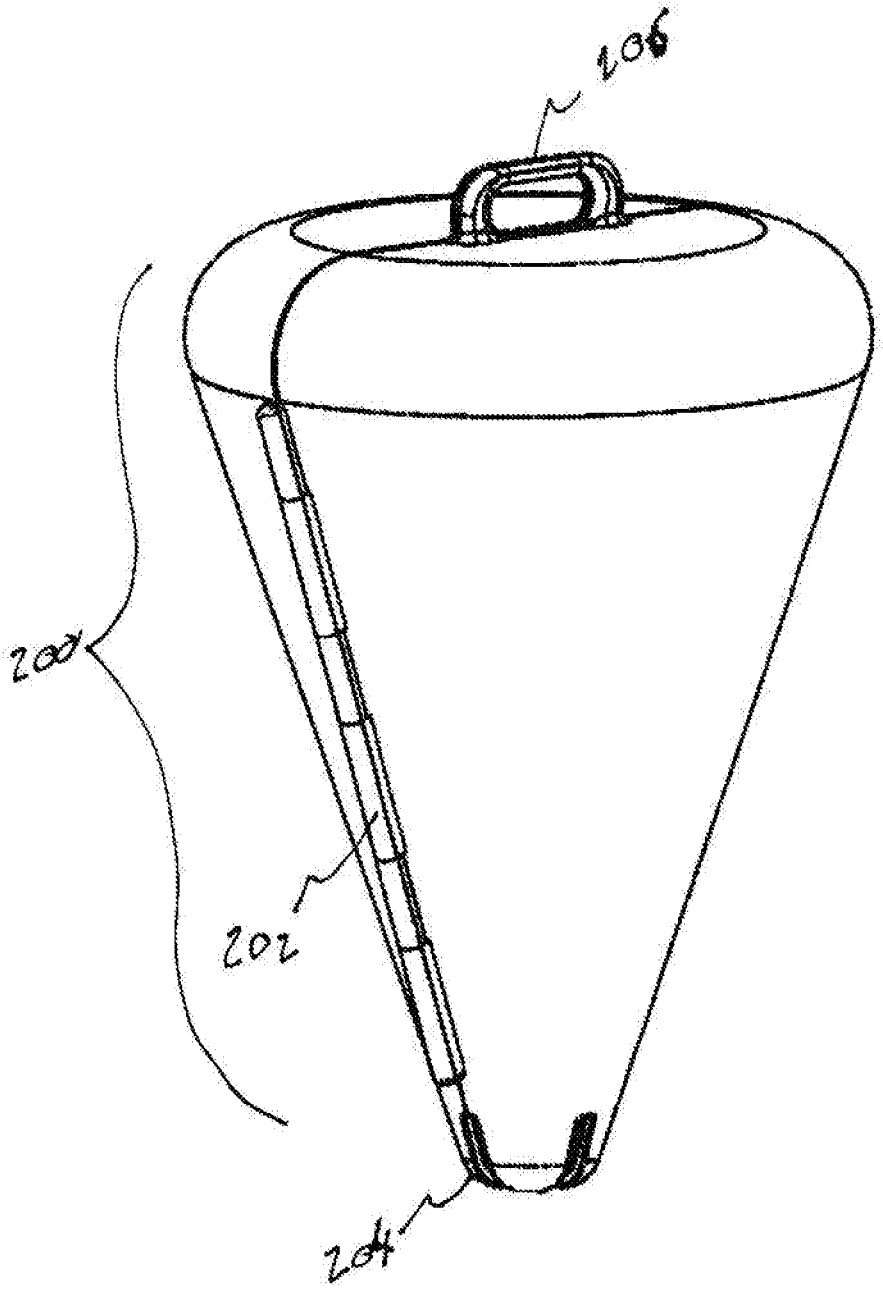
FIG. 6 is a perspective view of a second embodiment of the invention.

FIG. 6 is a perspective view of a second embodiment of the invention 200. This embodiment has the container split into two halves and held together by hinge member 202. As in the first embodiment, the funnel shape allows the golf tees to spontaneously be guided to the center exit port 204.

Figure 7:
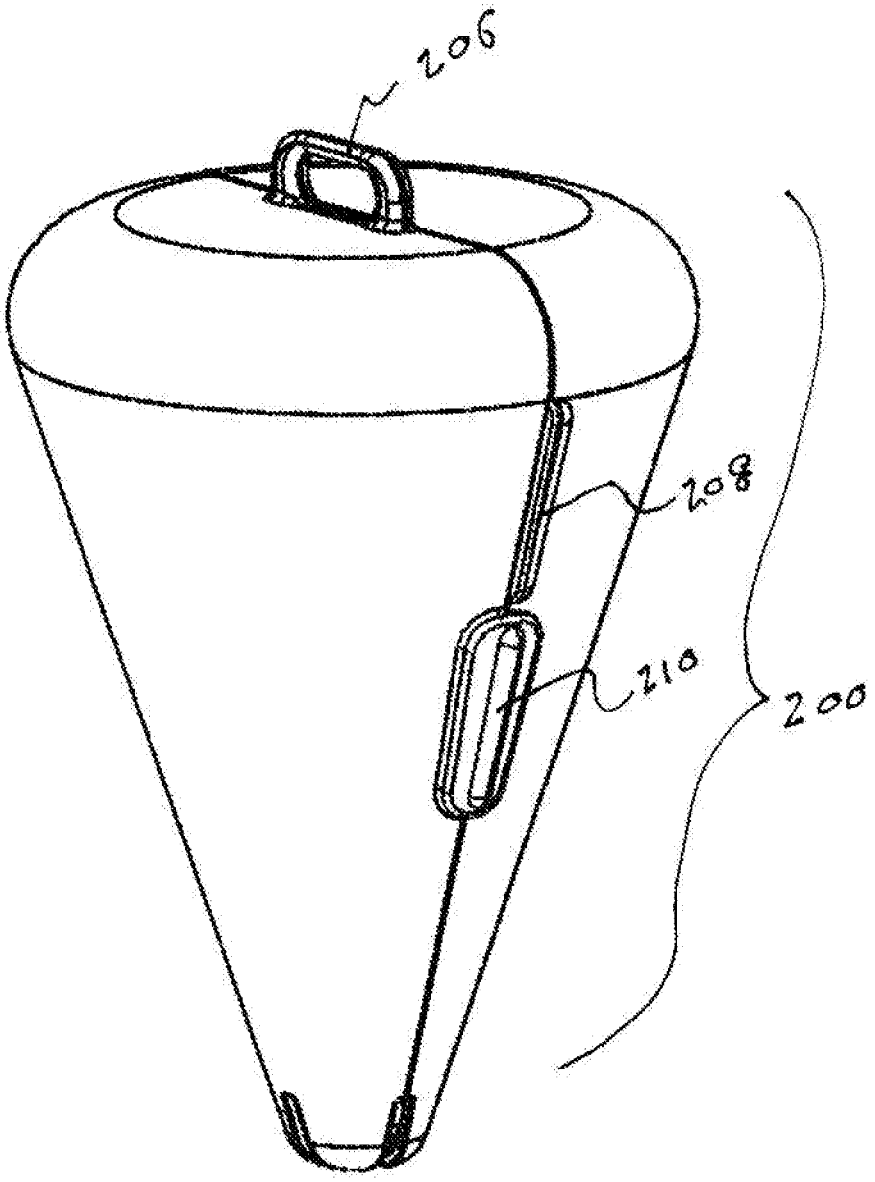
FIG. 7 is a perspective view of the second embodiment of the invention showing the snap closure.

FIG. 7 is another perspective view of the second embodiment of the invention 200 showing standard snap closure members 208, 210. This allows the device 200 to be easily opened and closed.

Inverted U shape 206 lets the user attach the device 200 to other items such as a golf club bag.

Figure 8:
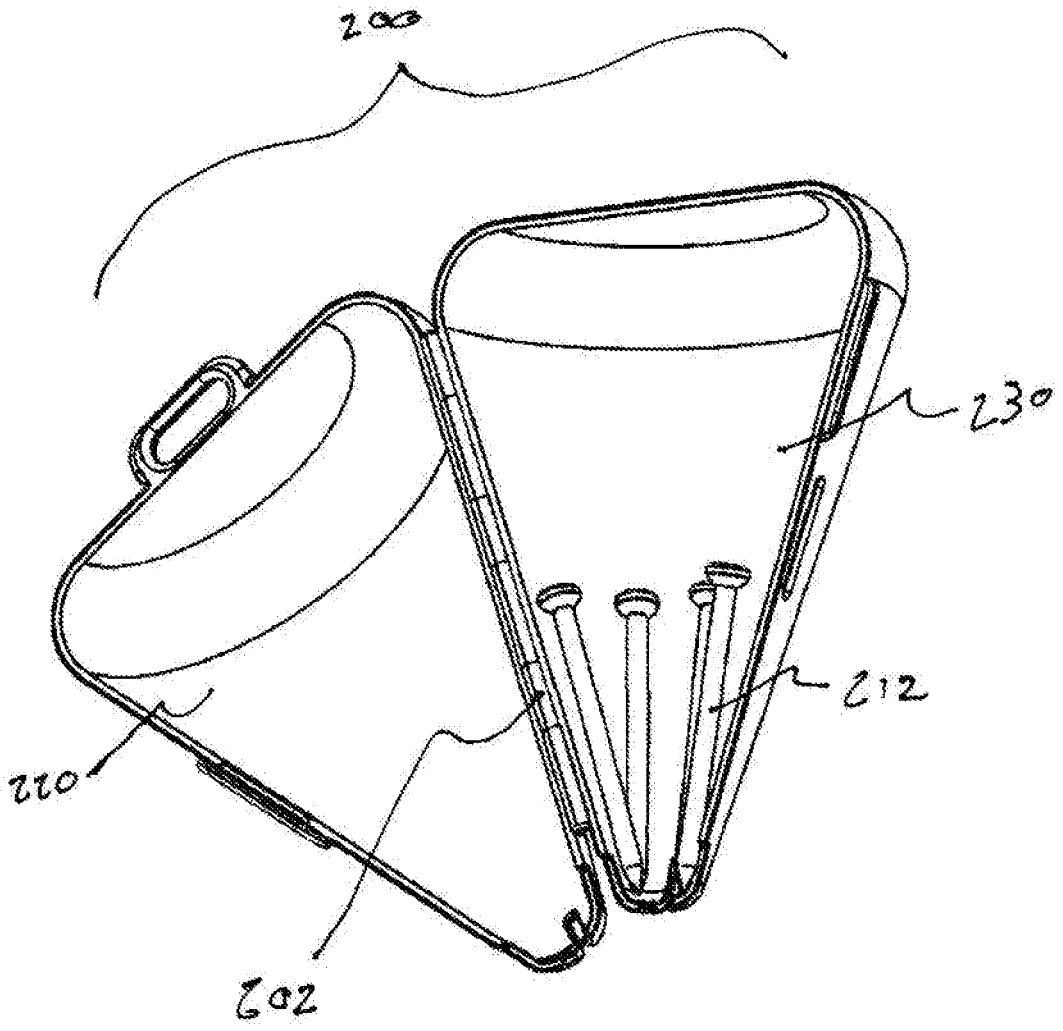
FIG. 8 is a perspective view of the second embodiment of the invention in the opened position.

FIG. 8 is a perspective view of the second embodiment of the invention showing the container halves 220, 230 in the open position. Allowing golf tees 212 to be easily loaded into the container 200.

Figure 9:
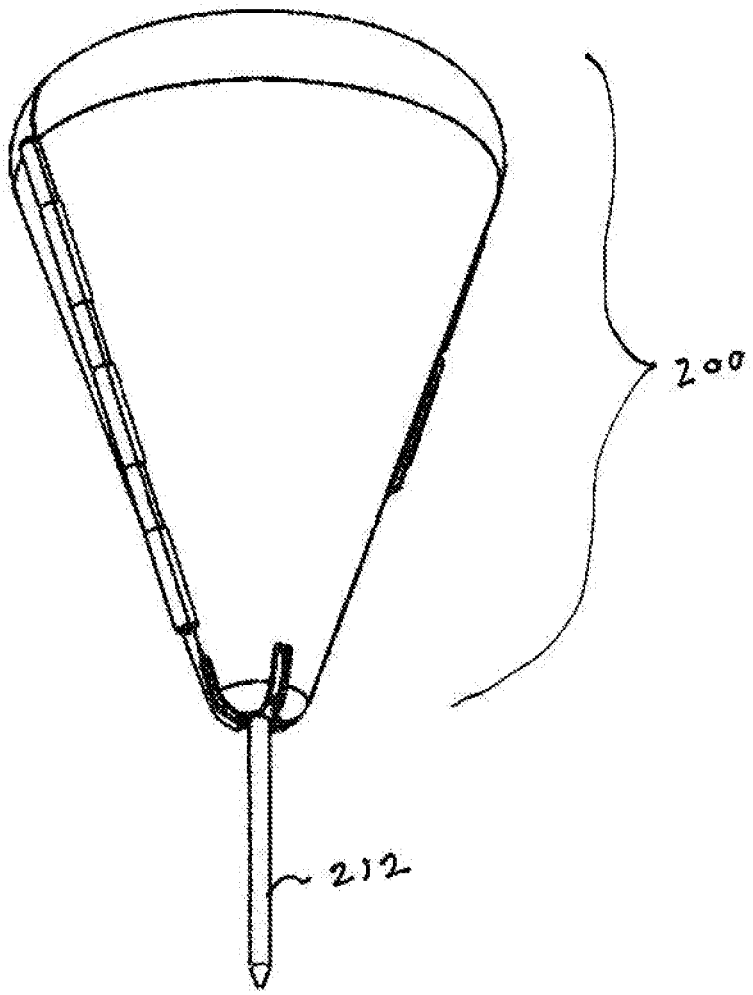
FIG. 9 is a perspective view of the second embodiment of the invention showing one tee ready to be dispensed.

FIG. 9 is a perspective view of the second embodiment of the invention showing one golf tee 212 partially dispensed and ready to be pulled out by the user.

Figure 10:
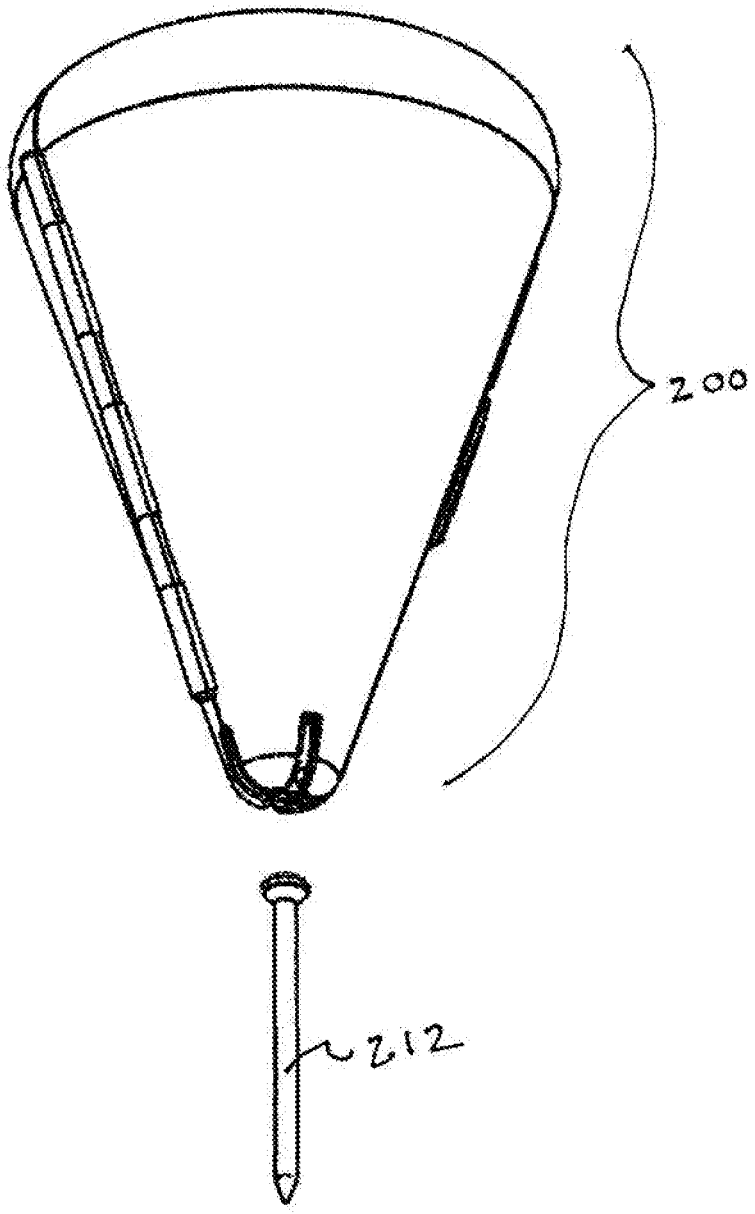
FIG. 10 is a perspective view of the second embodiment of the invention showing one tee dispensed from the container.

FIG. 10 is a perspective view of the second embodiment of the invention showing one golf tee 212 fully pulled out of the dispenser 200.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A golf tee dispenser comprising:

a funnel shaped container being an essentially hollow upside-down frustum of a cone, the frustum comprising a larger diameter top and a smaller diameter bottom and an angled wall, centered around the frustum axis connecting radial center of the frustum top and radial center of the frustum bottom;

a first retaining cap having an outside surface comprising mating threads;

a second retaining cap;

said funnel shaped container capable of holding a plurality of golf tees;

said funnel shaped container having a threaded cylindrical aperture at the bottom;

said first retaining cap removably retained to said funnel shaped container by the mating threads;

said second retaining cap comprising a ring and a tether; the ring movably holding the second retaining cap to the funnel shaped container above the first cap via the tether;

said first retaining cap includes a plurality of resilient fingers to facilitate the controlled release of one golf tee at a time from said funnel shaped container; and said second retaining cap frictionally retained to the outer surface of said first retaining cap.

2. The golf tee dispenser as claimed in claim 1 further comprising a U-shaped handle member fixedly attached to the top of said funnel shaped container.

3. The golf tee dispenser as claimed in claim 1 wherein the frustum wall angle of said funnel shaped container is approximately fifteen degrees with respect to the axis.

4. The golf tee dispenser as claimed in claim 1 wherein the funnel shaped container is split along the axis into essentially equal halves creating two cut sides, wherein the two halves are joined on one of the cut sides by a hinge and a snap fastener on the opposite cut side.

* * * * *